US009230471B2

(12) United States Patent
Montag

(10) Patent No.: US 9,230,471 B2
(45) **Date of Patent: *Jan. 5, 2016**

(54) SYSTEM AND METHOD FOR PROVIDING A MULTI-MODE EMBEDDED DISPLAY

(71) Applicant: Dell Products, LP, Round Rock, TX (US)

(72) Inventor: Bruce C. Montag, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/488,623

(22) Filed: Sep. 17, 2014

(65) Prior Publication Data

US 2015/0002495 A1 Jan. 1, 2015

Related U.S. Application Data

(63) Continuation of application No. 13/413,283, filed on Mar. 6, 2012, now Pat. No. 8,848,008.

(51) Int. Cl.
*G09G 3/20* (2006.01)
*G09G 5/00* (2006.01)

(52) U.S. Cl.
CPC ..... *G09G 3/2092* (2013.01); *G09G 5/006* (2013.01); *G09G 2310/0289* (2013.01); *G09G 2320/08* (2013.01); *G09G 2360/02* (2013.01); *G09G 2370/042* (2013.01); *G09G 2370/12* (2013.01); *G09G 2370/14* (2013.01)

(58) Field of Classification Search
None
See application file for complete search history.

(56) References Cited

U.S. PATENT DOCUMENTS

| | | | |
|---|---|---|---|
| 7,397,283 | B2 | 7/2008 | Chiu et al. |
| 7,788,412 | B2 | 8/2010 | Guo et al. |
| 2009/0201312 | A1 | 8/2009 | Wu et al. |
| 2010/0052743 | A1 | 3/2010 | Kamizuma et al. |
| 2010/0194994 | A1 | 8/2010 | Lee et al. |
| 2010/0328540 | A1 | 12/2010 | Wu et al. |
| 2011/0063501 | A1 | 3/2011 | Bar-Niv et al. |
| 2011/0133772 | A1 | 6/2011 | Shau |
| 2013/0235039 | A1 | 9/2013 | Montag |

*Primary Examiner* — David D Davis
(74) *Attorney, Agent, or Firm* — Larson Newman, LLP

(57) ABSTRACT

An information handling system includes a display panel, a panel connector, and a source device. The display panel displays images at different resolutions. The enables display data signals to be sent to the display panel. The source device determines whether an auxiliary channel is present between the source device and the panel connector, operates in a first embedded display operation mode if the auxiliary channel is present, otherwise determines if an enable signal has been received, and operates in a second embedded display operation mode when the enable signal has been received. The source device also communicates the display data signals to the display panel through the panel connector via a same set of pins of the source device during both the first embedded display operation mode and the second embedded display operation mode.

20 Claims, 7 Drawing Sheets

300

| Lane Count | MIPI DSI rev 1 (800 Mbps) | MIPI DSI rev 2 (1.2 Gbps) | eDP v1.1 (2.7 Gbps) | eDP v1.2 (5.4 Gbps) |
|---|---|---|---|---|
| 1 | WVGA (800 x 480) | WSVGA (1024 x 600) | WSXGA+ (1680 x 1050) | WUXGA (1920 x 1200) |
| 2 | HD (1280 x 720) | WXGA+ (1440 x 900) | WUXGA (1920 x 1200) | WQXGA (2560 x 1600) |
| 3 | WXGA+ (1440 x 900) | FHD (1920 x 1080) | N/A | N/A |
| 4 | WSXGA+ (1680 x 1050) | WUXGA (1920 x 1200) | WQXGA (2560 x 1600) | 4K x 2K (4096 x 2304) |

*FIG. 3*

SYSTEM AND METHOD FOR PROVIDING A MULTI-MODE EMBEDDED DISPLAY

CROSS REFERENCE TO RELATED APPLICATIONS

This application is a continuation of U.S. patent application Ser. No. 13/413,283, entitled "System and Method for Providing a Multi-Mode Embedded Display," filed on Mar. 6, 2012, now U.S. Pat. No. 8,848,008, the disclosure of which is hereby expressly incorporated by reference in its entirety.

FIELD OF THE DISCLOSURE

This disclosure generally relates to information handling systems, and more particularly relates to a system and method for providing a multi-mode embedded display.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements can vary between different applications, information handling systems can also vary regarding what information is handled, how the information is handled, how much information is processed, stored, or communicated, and how quickly and efficiently the information can be processed, stored, or communicated. The variations in information handling systems allow for information handling systems to be general or configured for a specific user or specific use such as financial transaction processing, airline reservations, enterprise data storage, or global communications. In addition, information handling systems can include a variety of hardware and software components that can be configured to process, store, and communicate information and can include one or more computer systems, data storage systems, and networking systems.

A mobile device, such as a notebook, tablet, or smart cellular telephone, may comply with different display standards. The display standards can include a mobile industry processor interface (MIPI) display serial interface (DSI) display standard, a low voltage differential signaling (LVDS) display standard, an embedded Display Port (eDP) display standard, a red green blue (RGB) display standard, a high definition multimedia interface (HDMI) display standard, and the like. The mobile device can include a source device, such as System on a Chip (SoC), to provide display data to a display panel in the mobile device. The display interface connectivity of the SoC can be based on different display sizes, resolutions, color depth, refresh rates, display connection topologies, and the like. The SoC can include forty pins dedicated to display interfaces, package size, and power requirement. The SoC design can have separate sets of electrical display interface pins for each of the different display standards. For example, the SoC can have a first set of pins for eDP display panel and a second set of pins for MIPI DSI display panel.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which:

FIG. 3 is a table showing different display requirements for the mobile industry processor interface display system and the embedded Display Port display system;

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be utilized in this application.

Figure 1:
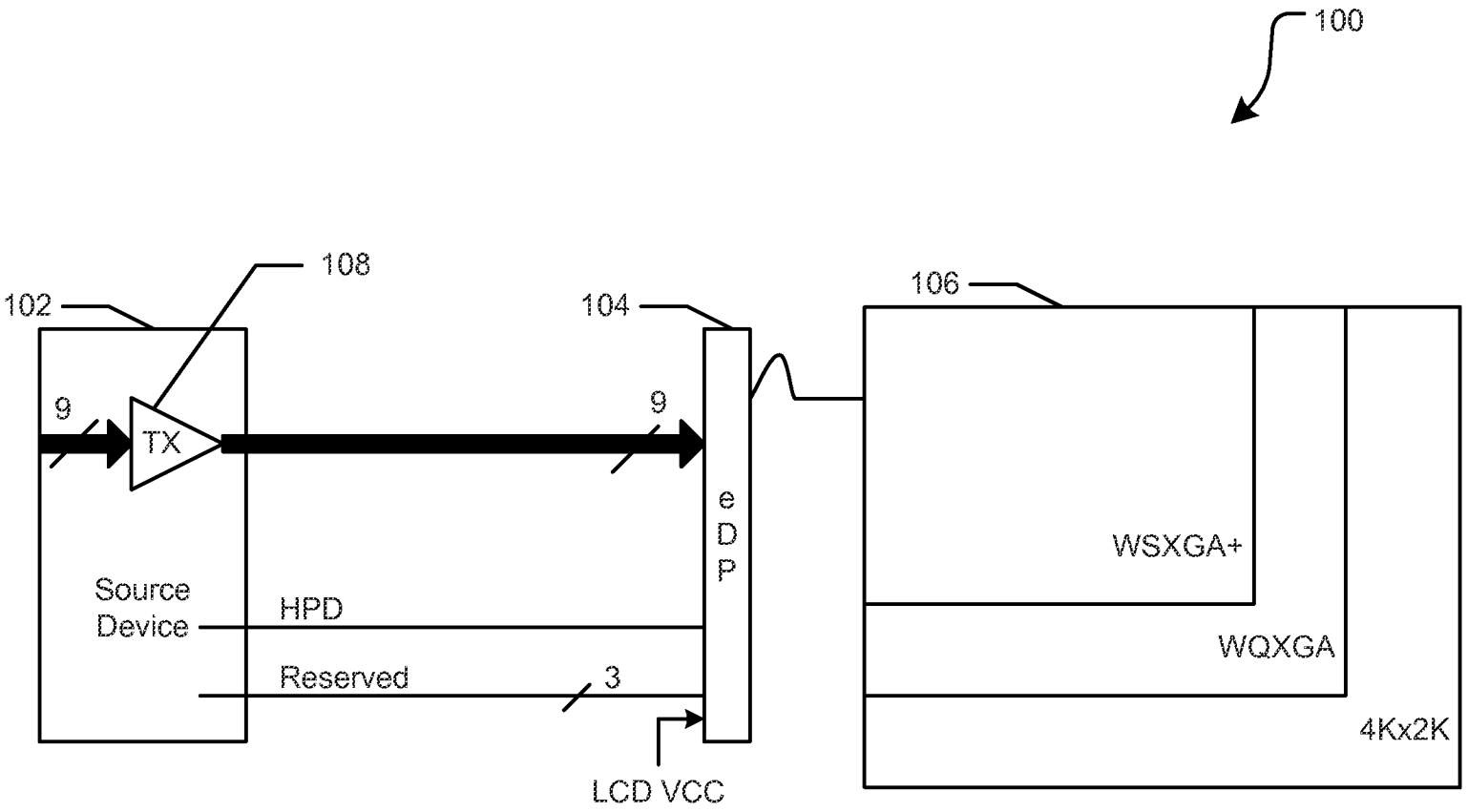
FIG. 1 is a block diagram of an embedded DisplayPort display system.

FIG. 1 illustrates a block diagram of an embedded DisplayPort (eDP) display system 100 for an information handling system. For purposes of this disclosure, the information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

The eDP display system 100 includes a source device 102, an eDP panel connector 104, and an eDP display 106. The source device 102 includes a transmitter 108. The source device 102 is in communication with the eDP panel connector 104, which in turn is in communication with the eDP display 106. The source device 102 can be a System on a Chip (SoC) device, which can be low power and compact for use in a mobile device. The mobile device can be a notebook, a tablet, a smart cellular telephone, and the like.

The eDP display 106 may be a display panel that can support different display resolutions such as wide super extended graphics array plus (WSXGA+), wide quad XGA (WQXGA), 4K×2K, and the like. The source device 102 can have direct communication with the eDP panel connector 104 via a hot plug detect communication bus. When the information handling system or mobile device is powered on, the source device 102 can determine whether an auxiliary channel is present between the source device and the panel connector 104. The source device 102 can then select an eDP operational mode from pre-configured display format parameters, and can bring up main links of the source device in the eDP operational mode. If the auxiliary channel is present, the source device 102 can retrieve extended display identification data (EDID) information from the eDP display 106 via the eDP panel connector 104. The source device 102 can utilize the EDID information white sending display data to the eDP display 106.

The source device 102 can utilize AC coupling signaling to transmit display data to the panel connector 104 and to the eDP display 106. The source device 102 can receive the display data from a processor of the mobile device via a communication bus, and can utilize the transmitter 108 to send the display data to the eDP panel connector 104 via a communication bus. In an embodiment the communication bus between the processor of the mobile device and the transmitter 108, as well as the communication bus between transmitter 108 and the eDP panel connector 104 can both be nine bit communication buses. The eDP panel connector 104, can then transmit the display data to the eDP display 106 with a specific resolution as defined in information associated with the display data. During the eDP operational mode, the source device 102 can utilize one or more eDP main link lanes to send the display data to the eDP display 106.

Figure 2:
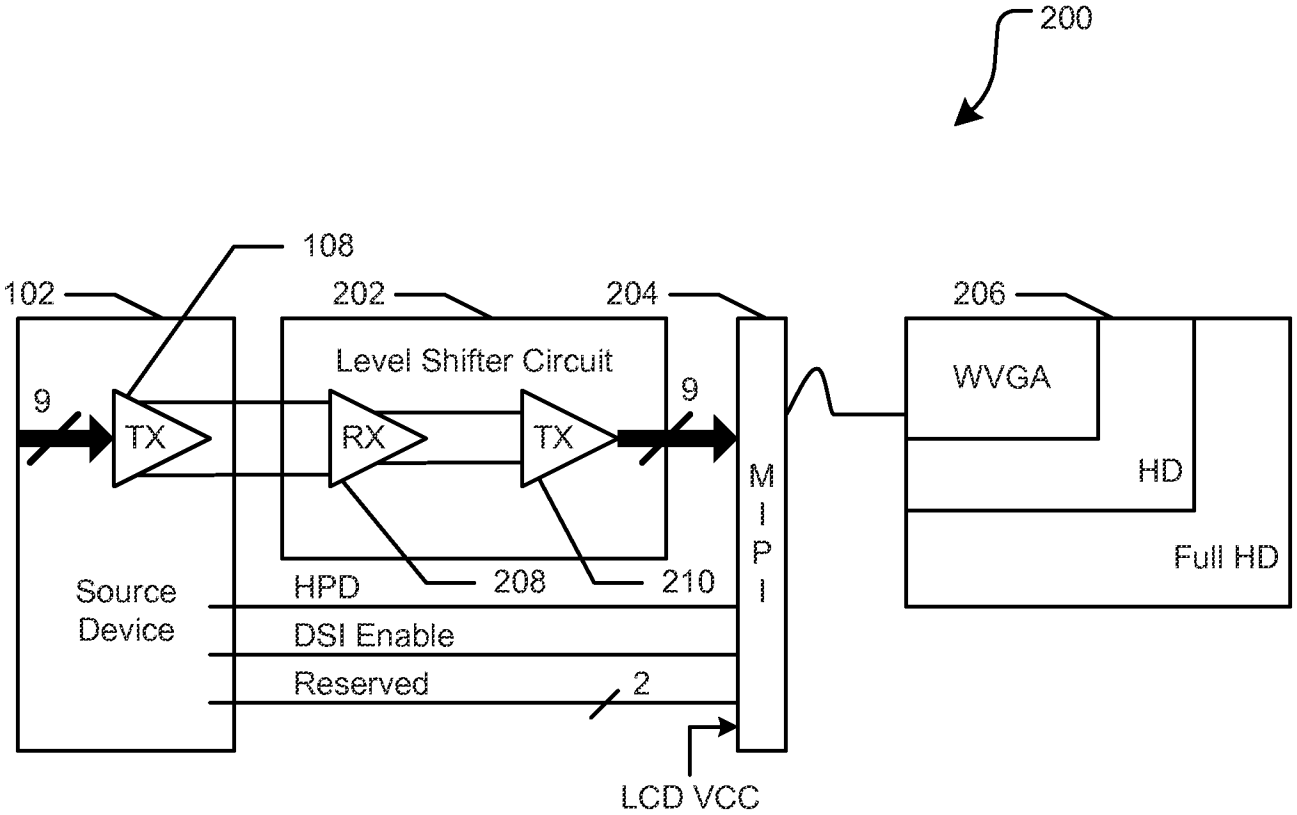
FIG. 2 is a block diagram of a mobile industry processor interface display system.

FIG. 2 shows a mobile industry processor interface (MIPI) system 200 including a level shifter 202, a MIPI panel connector 204, a MIPI display 206, and the source device 102. The source device 102 includes the transmitter 108. The level shifter 202 includes a receiver 208 and a transmitter 210. The source device 102 is in communication with the level shifter 202, which in turn is in communication with the MIPI panel connector 204. The MIPI panel connector 204 is in communication with the MIPI display 206. The source device 102 is also in communication with the MIPI panel connector 204. The MIPI display 206 can support a wide video graphics array (WVGA) display standard, a high definition (HD) display standard, a full HD (FHD) display standard, and the like.

The MIPI display system 100 can utilize direct current (DC) coupled signaling to transmit the display data signals from the MIPI panel connector 204 to the MIPI display 206. However, as stated above the transmitter 108 of the source device 102 utilizes AC coupled signaling. Thus, the level shifter 202 can be used to change the signaling from being AC coupled to DC coupled. Therefore, the transmitter 108 of the source device 102 can communicate display data as a common mode AC signal to the receiver 208 of the level shifter. The receiver 208 can then transmit the display data to the transmitter 210 of the level shifter 202 to boost a voltage of the display data signal from a voltage having a swing around zero to a voltage having a swing above zero with a top voltage at a desired DC voltage for the NM display 206.

The source device 102 can have direct communication with the MIPI panel connector 204 via a hot plug detect communication bus and a display serial interface (DSI) enabled communication bus. When the information handling system or mobile device is powered on, the source device 102 can determine whether an auxiliary channel is present between the source device and the panel connector 204. If the auxiliary channel is not present the source device 102 can determine whether a DSI enabled signal is present on the DSI enabled communication bus. If the DSI signal is present then the source device 102 can determine that the MIPI panel connector 204 and the MIPI display 206 are installed in the information handling system. The source device 102 can then select a MIPI DSI operation mode from pre-configured display format parameters, and can bring up main links of the source device in the MIPI DSI operation mode. During the MIPI operation mode, the source device 102 can map three DSI data channels to eDP main link lanes zero through two, a DSI clock signal to eDP main link lane three, and a hot plug detect signal from the MIPI panel connector to eDP hot plug detect pin.

The source device 102 can receive display data from a processor of the mobile device via a communication bus, and can utilize the transmitter 108 to send the display data to the receiver 208 of the level shifter 202 via a common mode communication signal. The level shifter 202 can then utilize the transmitter 210 to send the display data to the MIPI panel connector 204 via a communication bus. In an embodiment, the communication bus between the processor of the mobile device and the transmitter 108 as well as the communication bus between transmitter 210 and the MIPI panel connector 204 can both be nine bit communication buses.

The MIPI panel connector 204 can then transmit the display data to the MIPI display 206 with a specific resolution. The display resolution for the MIPI DSI display 206 can vary based on a version of the MIPI DSI standard utilized by the source device 102, as shown in FIG. 3. The majority of MIPI displays in mobile devices are low resolution, such as lower than 720 dpi and can operate with only two DSI data channels. However, the mapping of the third main link lane to a DSI data channel can enable the MIPI display 206 of a mobile device to operate at a FHD resolution such as 1920×1080 dpi.

FIG. 3 shows a resolution table 300 for both the MIPI DSI operation mode and the eDP operational mode. The source device 102 can utilize only one communication link or channel for display resolutions in the MIPI display 206 of either WVGA or wide super VGA (WSVGA), and for display resolutions in the eDP display 106 of either WSXGA+ or widescreen ultra XGA (WUXGA). The WVGA can have a resolution of 800×480, and WSVGA can have a resolution of 1024×600. The WSXGA+ can have a resolution of 1680×1050, and WUXGA can have a resolution of 1920×1200.

The source device 102 can utilize two communication links or channels for display resolutions in the MIPI display 206 of either HD or wide extended graphics array plus (WXGA+), and for display resolutions in the eDP display 106 of either WUXGA or WQXGA. The HD can have a resolution of 1280×720, the WXGA+ can have a resolution of 1440×900, and the WQXGA can have a resolution of 2560×1600. The source device 102 can utilize three communication links or channels for display resolutions in the MIPI display 206 of either WXGA+ or FHD. The FHD can have a resolution of 1920×1080. The source device 102 can utilize four communication links or channels for display resolutions in the MIPI display 206 of either WSXGA+ or widescreen ultra XGA (WUXGA), and for display resolutions in the eDP display 106 of either WQXGA or 4K×2K. The WSXGA+ can have a resolution of 1680×1050, WUXGA can have a resolution of 1920×1200, and the 4K×2K can have a resolution of 4096×2304.

Figure 4:
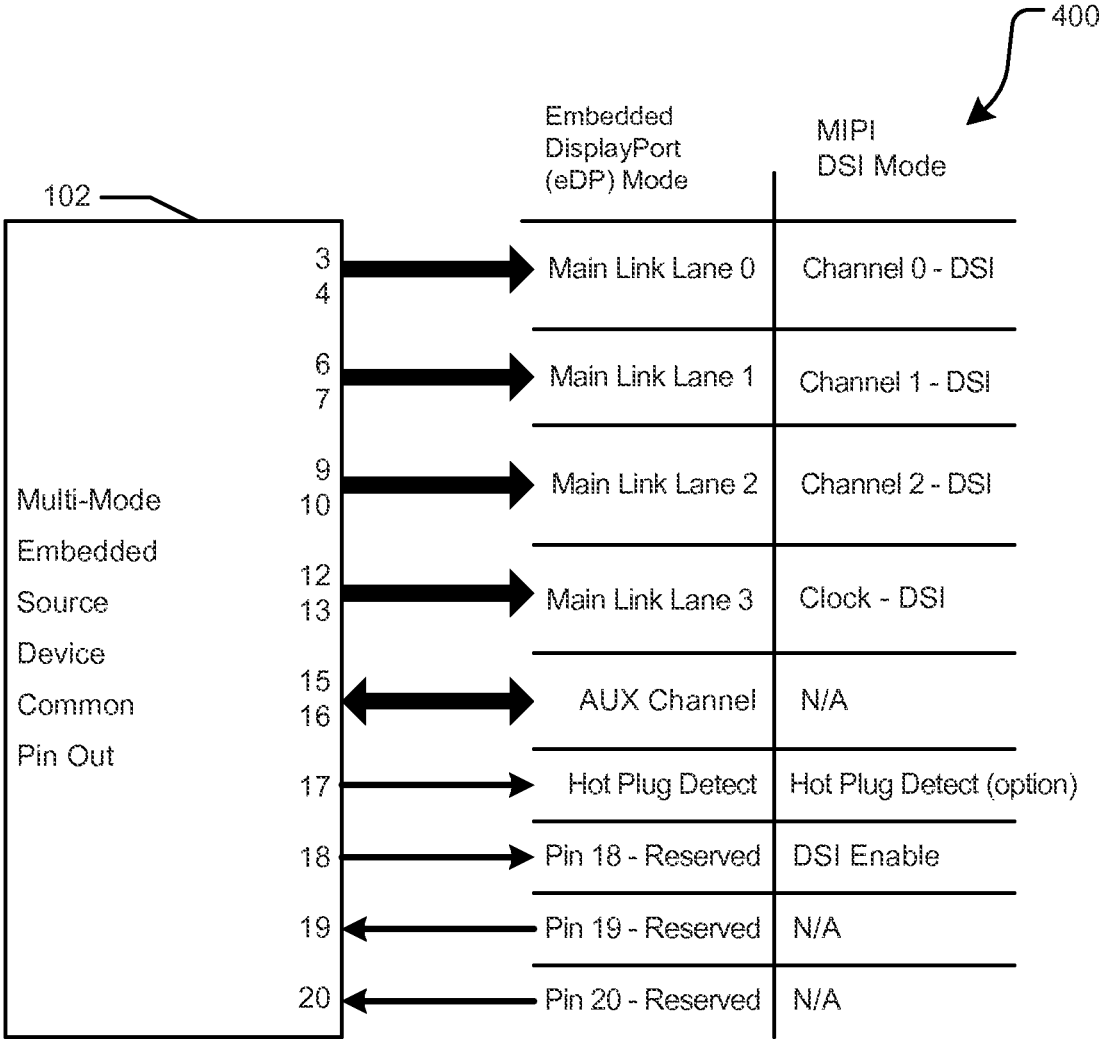
FIG. 4 is a block diagram of a source device of a display system and a lane mapping table for the source device.

FIG. 4 shows a block diagram of the source device 102 and a lane mapping table 400 for the source device 102. The pins, such as pins 3-4, 6-7, 9-10, 12-13, 15-16, and 17-20 of the source device 102 can be mapped to different uses or operations depending on the embedded display interface operation. In a system utilizing the eDP operational mode, the main links, such as pins 3-4, 6-7, 9-10, 12-13, and 15-16 of the source device 102 can be mapped to one to four high speed data lanes, a bi-directional auxiliary channel, and embedded clocking. Display data can be transmitted on the main links of the eDP operational mode using AC coupled signaling. However, in a system utilizing the MIPI DSI operational mode, the main links of the source device 102 can be mapped to one to three low speed data lanes and a clock signal. Data can be transmitted on the main links of the MIPI DSI operational mode using DC coupled signaling.

The source device 102 can have a standard mapping for the eDP operational mode. For example, the lane mapping table 400 shows that the first four main links, pins 3-4, 6-7, 9-10, and 12-13 can be used as data lanes and the fifth main link, pins 15-16, can be mapped as the auxiliary channel in the eDP operational mode. Pin 17 can be used as a hot plug detect bus to determine whether an eDP display panel has been connected to the source 102 in the eDP operational mode. Pins 18-20 can be reserved in the eDP operational mode.

During the MIPI DSI operation mode, a DSI clock lane can be mapped to the eDP main link 3, pins 12-13, which can allow up to three DSI data channels to be mapped in any order to the eDP main link lines 0-2. The DSI enabled signal can be mapped to eDP pin 18 for detection of the MIPI display 206. In an embodiment, a hot plug detect signal may be mapped from the MIPI panel connector to the eDP hot plug detect pin 17. Thus, the source device 102 can use the same set of pins for communicating display data in both the eDP operation mode and the MIPI operation mode.

Figure 5:
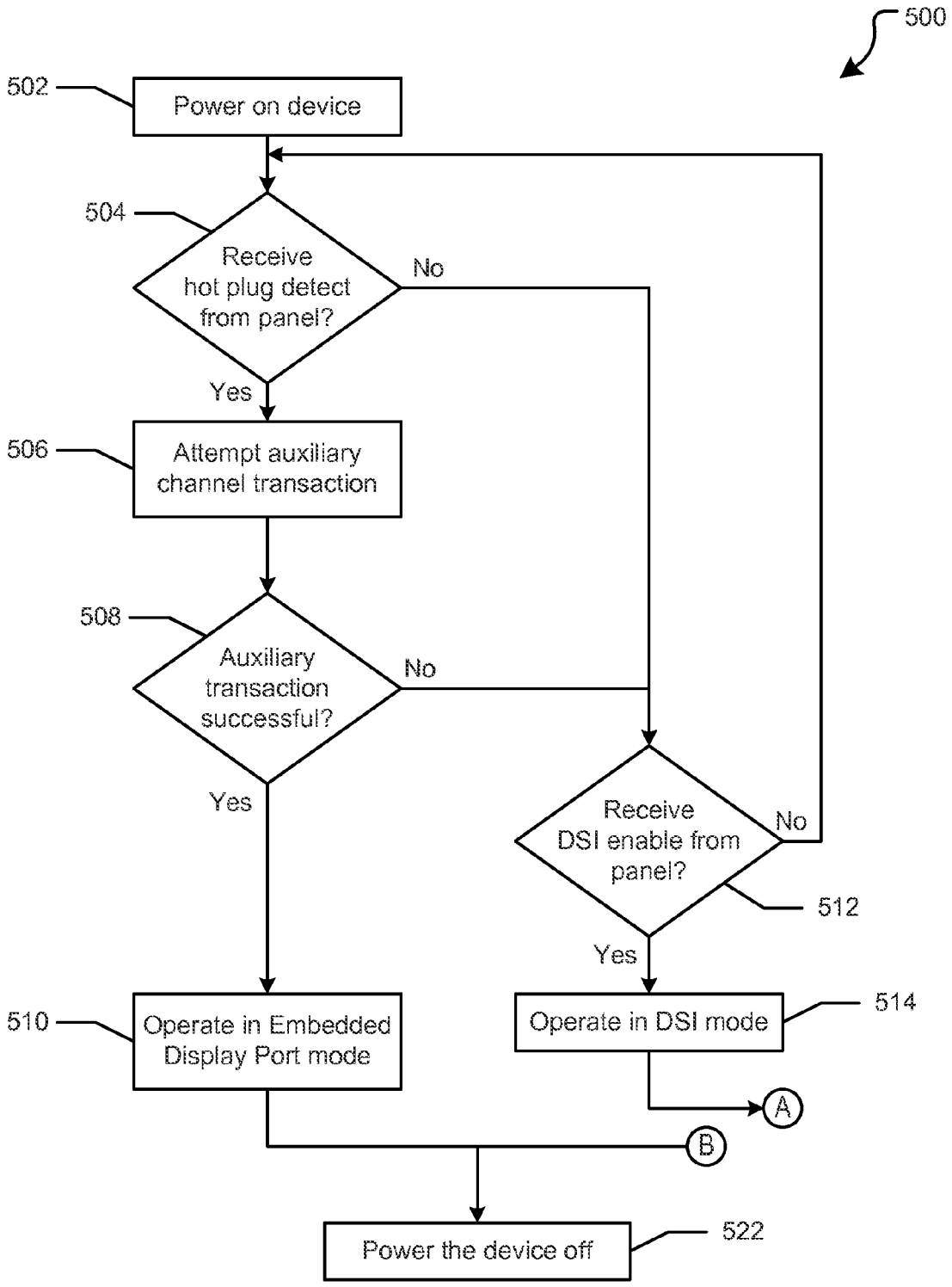
FIGS. 5 and 6 are a flow diagram of a method for providing a multi-mode embedded display interface in a mobile device.
Figure 6:
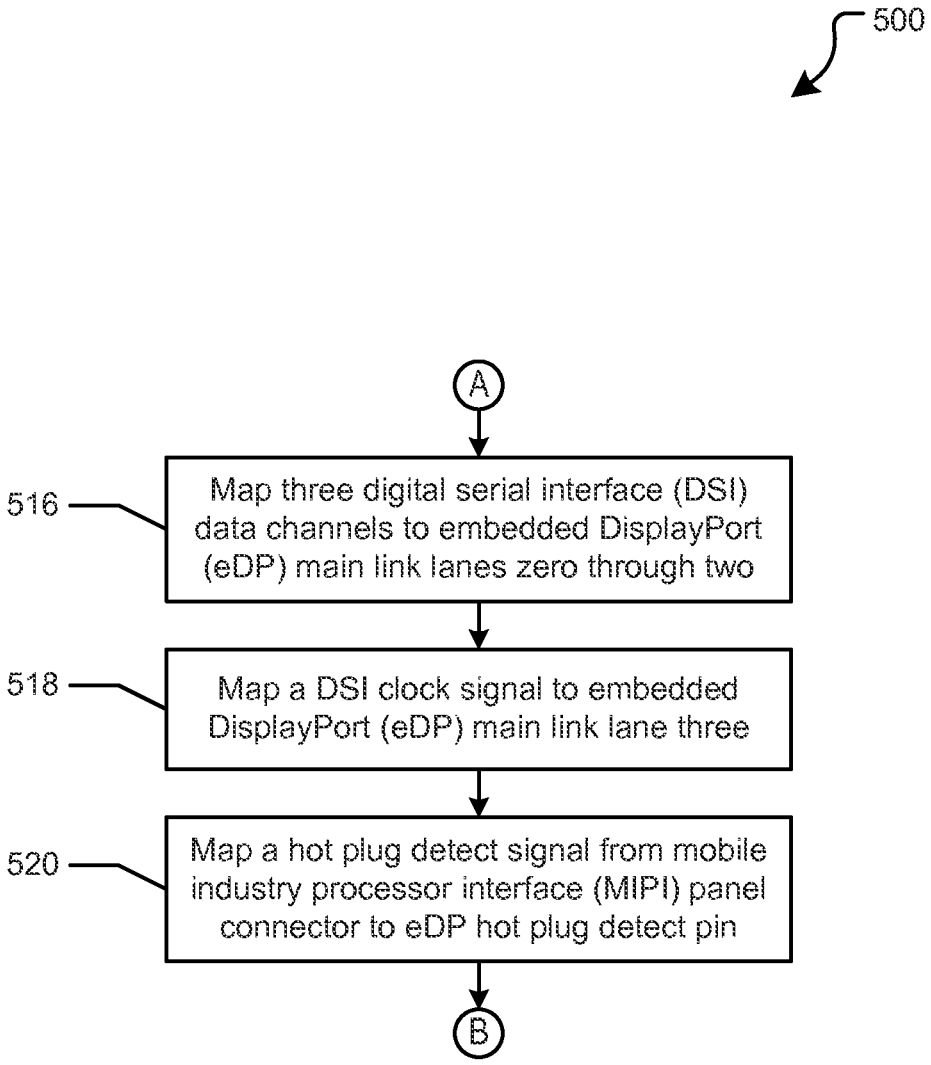

FIG. 5 shows a method 500 for providing multi-mode embedded display interface. At block 502, a mobile device is powered on. The mobile device can be a notebook, a tablet, a smart cellular telephone, or the like. A determination is made whether a hot plug detect signal is received from a display panel of the device at block 504. If the hot plug detect signal is not received the flow continues at block 512 below. If the hot plug detect signal is received, an auxiliary channel transaction is attempted between a source device within the user device and a display interface panel at block 506. At block 508, a determination is made whether the auxiliary transaction is successful.

If the auxiliary transaction is successful, the source device is operated in eDP mode at block 510. If the auxiliary transaction is not successful, a determination is made whether a DSI enabled signal is received from the display interface panel at block 512. If the DSI enabled signal is not received, the flow continues as stated above at block 504. However, if the DSI enabled signal is received, the source device is operated in a DSI mode at block 514.

At block 516, three DSI data channels are mapped to eDP main link lanes zero through two. A DSI clock signal is mapped to eDP main link lane three at block 518. At block 520, a hot plug detect signal from the NM panel connector is mapped to eDP hot plug detect pin. At block 522, the user device is powered off.

Figure 7:
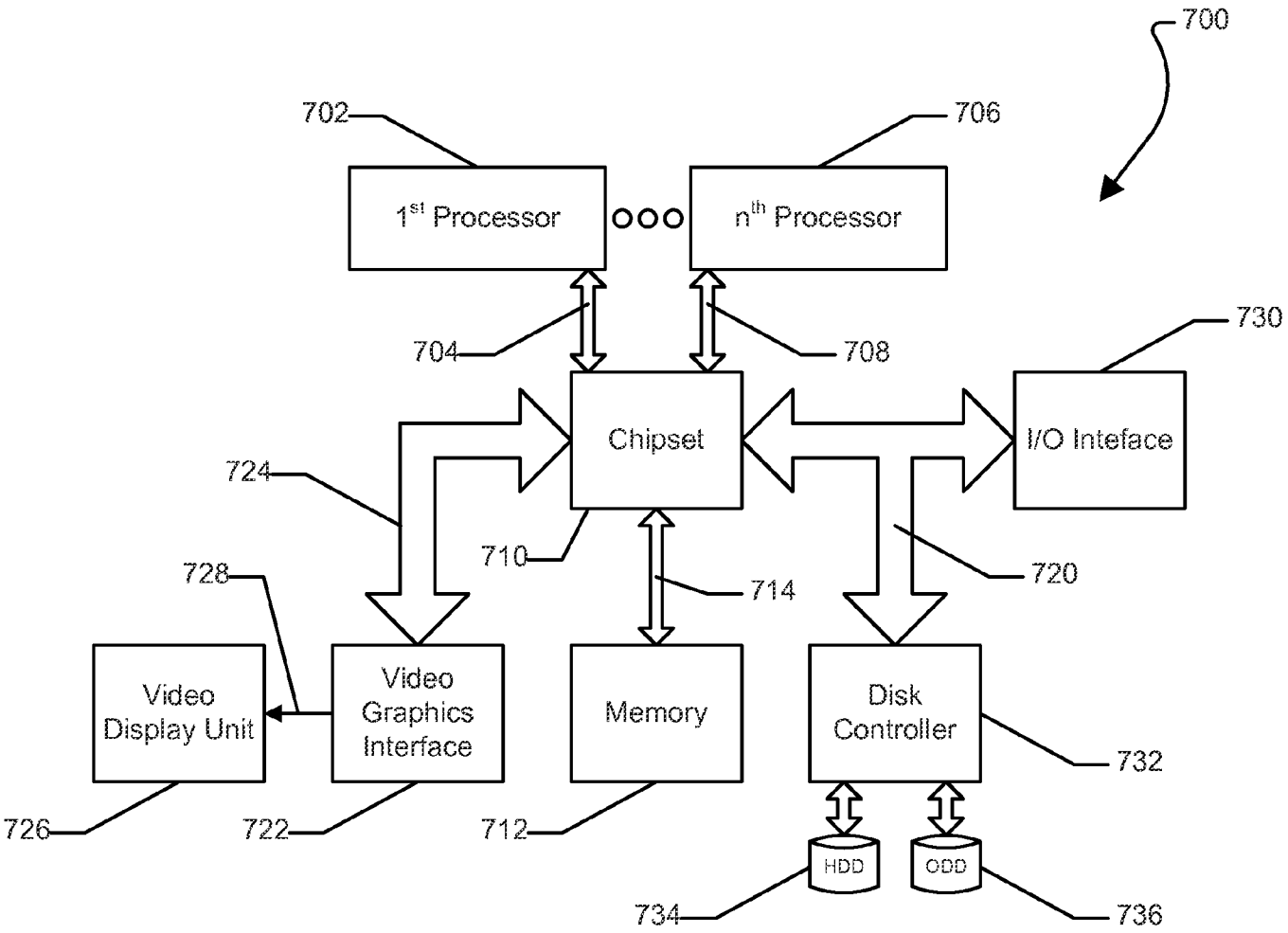
FIG. 7 is a block diagram of a general information handling system.

As shown in FIG. 7, the information handling system 700 can include a first physical processor 702 coupled to a first host bus 704 and can further include additional processors generally designated as $n^{th}$ physical processor 706 coupled to a second host bus 708. The first physical processor 702 can be coupled to a chipset 710 via the first host bus 704. Further, the $n^{th}$ physical processor 706 can be coupled to the chipset 710 via the second host bus 708. The chipset 710 can support multiple processors and can allow for simultaneous processing of multiple processors and support the exchange of information within information handling system 700 during multiple processing operations.

According to one aspect, the chipset 710 can be referred to as a memory hub or a memory controller. For example, the chipset 710 can include an Accelerated Hub Architecture (AHA) that uses a dedicated bus to transfer data between first physical processor 702 and the $n^{th}$ physical processor 706. For example, the chipset 710, including an AHA enabled-chipset, can include a memory controller hub and an input/output (I/O) controller hub. As a memory controller hub, the chipset 710 can function to provide access to first physical processor 702 using first bus 704 and $n^{th}$ physical processor 706 using the second host bus 708. The chipset 710 can also provide a memory interface for accessing memory 712 using a memory bus 714. In a particular embodiment, the buses 704, 708, and 714 can be individual buses or part of the same bus. The chipset 710 can also provide bus control and can handle transfers between the buses 704, 708, and 714.

According to another aspect, the chipset 710 can be generally considered an application specific chipset that provides connectivity to various buses, and integrates other system functions. For example, the chipset 710 can be provided using an Intel® Hub Architecture (IHA) chipset that can also include two parts, a Graphics and AGP Memory Controller Hub (GMCH) and an I/O Controller Hub (ICH). For example, an Intel 820E, an 815E chipset, or any combination thereof, available from the Intel Corporation of Santa Clara, Calif., can provide at least a portion of the chipset 710. The chipset 710 can also be packaged as an application specific integrated circuit (ASIC).

The information handling system 700 can also include a video graphics interface 722 that can be coupled to the chipset 710 using a third host bus 724. In one form, the video graphics interface 722 can be an Accelerated Graphics Port (AGP) interface to display content within a video display unit 726. Other graphics interfaces may also be used. The video graphics interface 722 can provide a video display output 728 to the video display unit 726. The video display unit 726 can include one or more types of video displays such as a flat panel display (FPD) or other type of display device.

The information handling system 700 can also include an I/O interface 730 that can be connected via an I/O bus 720 to the chipset 710. The I/O interface 730 and I/O bus 720 can include industry standard buses or proprietary buses and respective interfaces or controllers. For example, the I/O bus 720 can also include a Peripheral Component Interconnect (PCI) bus or a high speed PCI-Express bus. In one embodiment, a PCI bus can be operated at approximately 66 MHz and a PCI-Express bus can be operated at more than one speed, such as 2.5 GHz and 4 GHz. PCI buses and PCI-Express buses can be provided to comply with industry standards for connecting and communicating between various PCI-enabled hardware devices. Other buses can also be provided in association with, or independent of, the I/O bus 720 including, but not limited to, industry standard buses or proprietary buses, such as Industry Standard Architecture (ISA), Small Computer Serial Interface (SCSI), Inter-Integrated Circuit ($I^2C$), System Packet Interface (SPI), or Universal Serial buses (USBs).

In an alternate embodiment, the chipset 710 can be a chipset employing a Northbridge/Southbridge chipset configuration (not illustrated). For example, a Northbridge portion of the chipset 710 can communicate with the first physical processor 702. The Northbridge portion of the chipset 710 can control interaction with the memory 712, with the I/O bus 720 that can be operable as a PCI bus, and with activities for the video graphics interface 722. The Northbridge portion can also communicate with the first physical processor 702 using first bus 704 and the second bus 708 coupled to the $n^{th}$ physical processor 706. The chipset 710 can also include a Southbridge portion (not illustrated) of the chipset 710 and can handle I/O functions of the chipset 710. The Southbridge portion can manage the basic forms of I/O such as Universal Serial Bus (USB), serial I/O, audio outputs, Integrated Drive Electronics (IDE), and ISA I/O for the information handling system 700.

The information handling system 700 can further include a disk controller 732 coupled to the I/O bus 720, and connecting one or more internal disk drives such as a hard disk drive (HDD) 734 and an optical disk drive (ODD) 736 such as a Read/Write Compact Disk (R/W CD), a Read/Write Digital Video Disk (R/W DVD), a Read/Write mini-Digital Video Disk (R/W mini-DVD), or other type of optical disk drive.

Although only a few exemplary embodiments have been described in detail in the exemplary embodiments without materially departing from the novel teachings and advantages of the embodiments of the present disclosure. For example, the methods described in the present disclosure can be stored as instructions in a computer readable medium to cause a processor, such as chipset 710, to perform the method. Additionally, the methods described in the present disclosure can be stored as instructions in a non-transitory computer readable medium, such as a hard disk drive, a solid state drive, a flash memory, and the like. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. An information handling system comprising:

a panel connector to enable display data signals to be sent to a display panel; and a source device in communication with the panel connector, the source device to determine whether an auxiliary channel is present between the source device and the panel connector, to operate in a first embedded display operation mode if the auxiliary channel is present, otherwise to determine if an enable signal has been received, and to operate in a second embedded display operation mode when the enable signal has been received.

2. The information handling system of claim 1 further comprising:

a level shifter in communication with the source device and the panel connector, the level shifter to boost a voltage of the display data signals from the source device from a swing around zero volts to have a desired top direct current voltage prior to providing the display data signals to the panel connector.

3. The information handling system of claim 1 wherein the source device communicates the display data signals to the display panel through the panel connector via a same set of pins of the source device during both the first embedded display operation mode and the second embedded display operation mode.

4. The information handling system of claim 1 wherein the source device maps a digital serial interface data channel to a first embedded DisplayPort main link lane of the source device in response to the second embedded display operation mode, and the source device maps a digital serial interface clock signal to a second embedded DisplayPort main link lane of the source device in response to the second embedded display operation mode.

5. The information handling system of claim 1 wherein the first embedded display operation mode is an embedded DisplayPort operational mode, and the second embedded display operation mode is a mobile industry portable interface operation mode.

6. The information handling system of claim 1 wherein the display panel is selected from a group consisting of an embedded DisplayPort display panel and a mobile industry portable interface display panel.

7. The information handling system of claim 1 wherein the enable signal is received on a link that is reserved in the first embedded display operational mode.

8. A method comprising:

determining, at a source device, whether a hot plug detect signal is received from a panel connector;

operating the source device in a first embedded display operation mode in response to the hot plug detect signal being received;

determining whether an enable signal is received from the panel connector in response to the hot plug detect signal not being received; and operating the source device in a second embedded display operation mode in response to the enable signal being received.

9. The method of claim 8 further comprising:

boosting, via a level shifter, a voltage of the display data signals from the source device from a swing around zero volts to have a desired top direct current voltage prior to providing the display data signals to the panel connector.

10. The method of claim 8 wherein the source device communicates display data signals to a display panel via a same set of pins of the source device during both the first embedded display operation mode and the second embedded display operation mode.

11. The method of claim 8 further comprising:

mapping a digital serial interface data channel to a first embedded DisplayPort main link lane of the source device in response to the second embedded display operation mode; and mapping a digital serial interface clock signal to a second embedded DisplayPort main link lane of the source device in response to the second embedded display operation mode.

12. The method of claim 8 wherein the enable signal is received on a link that is reserved in the first embedded display operational mode.

13. The method of claim 8 wherein the first embedded display operation mode is an embedded DisplayPort operational mode, and the second embedded display operation mode is a mobile industry portable interface operation mode.

14. An information handling system comprising:

a memory; and a processor to execute instructions stored in the memory to cause the processor to at least:

determine, at a source device, whether a hot plug detect signal is received from a panel connector;

operate the source device in a first embedded display operation mode when the hot plug detect signal is received;

determine whether an enable signal is received from the panel connector in response to the hot plug detect signal not being received; and operate the source device in a second embedded display operation mode when the enable signal is received.

15. The information handling system of claim 14 wherein the instructions further cause the processor to:

boost, via a level shifter, a voltage of the display data signals from the source device from a swing around zero volts to have a desired top direct current voltage prior to providing the display data signals to the panel connector.

16. The information handling system of claim 14 wherein the source device communicates display data signals to a display panel via a same set of pins of the source device during both the first embedded display operation mode and the second embedded display operation mode.

17. The information handling system of claim 14 wherein the instructions further cause the processor to:

prior to the source device being operated in the first embedded display operation mode, attempt to complete an auxiliary channel communication in response to the hot plug detect signal being received.

18. The information handling system of claim 14 wherein the instructions further cause the processor to:

map a digital serial interface data channel to a first embedded DisplayPort main link lane of the source device in response to the second embedded display operation mode; and map a digital serial interface clock signal to a second embedded DisplayPort main link lane of the source device in response to the second embedded display operation mode.

19. The information handling system of claim 14 wherein the enable signal is received on a link that is reserved in the first embedded display operational mode.

20. The information handling system of claim 14 wherein the first embedded display operation mode is an embedded DisplayPort operational mode, and the second embedded display operation mode is a mobile industry portable interface operation mode.

* * * * *